US005083935A

United States Patent [19]

Herman

[11] Patent Number: 5,083,935

[45] Date of Patent: Jan. 28, 1992

[54] ELECTRICAL CONNECTOR

[75] Inventor: Rodney A. Herman, Alameda, Calif.

[73] Assignee: Monster Cable Products, Inc., South San Francisco, Calif.

[21] Appl. No.: 686,659

[22] Filed: Apr. 17, 1991

Related U.S. Application Data

[63] Continuation of Ser. No. 481,973, Feb. 16, 1990, abandoned.

[51] Int. Cl.[5] ..... H01R 4/24

[52] U.S. Cl. ..... 439/433; 439/429; 174/87

[58] Field of Search ..... 439/413, 415, 427, 428, 439/429, 433, 434, 791, 792; 174/87

[56] References Cited

U.S. PATENT DOCUMENTS 1,419,523 6/1922 Schleper ..... 174/87

1,762,039 6/1930 Van Gelderen ..... 174/87

FOREIGN PATENT DOCUMENTS

WO/8705447 2/1987 PCT Int'l Appl. .

458749 12/1936 United Kingdom ..... 439/415

*Primary Examiner*—David L. Pirlot

*Attorney, Agent, or Firm*—Rosen, Dainow & Jacobs

[57] ABSTRACT

A one-piece, solderless, non-crimp electrical wire connector for effecting connection between the stripped end of an insulated electrical conductor and a socket of a terminal of the type having a plug-receiving bore, including a conductive body member having a tapered bore extending inwardly from an end thereof, the bore being tapered to its small end and open at its large end to receive an electrical conductor, the conductor-receiving bore having internal threads for engaging and gripping the conductor, the threads acting as a non-abrasive metal-working surface, an elongated plug member extending generally axially from the opposite end of the body member, the plug member adapted to be inserted and seated upon a complementary socket of a terminal, wherein rotating the connector on the conductor causes the threaded surfaces of the bore to engage and be pressed into the conductor, locking the conductor within the bore and forming an electrical connection.

9 Claims, 1 Drawing Sheet

Fig. 1.
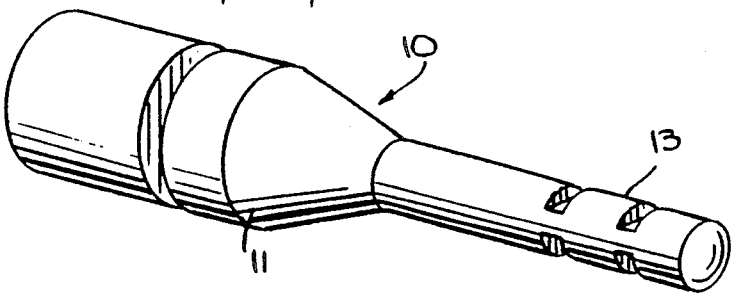
Fig. 2.
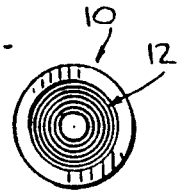
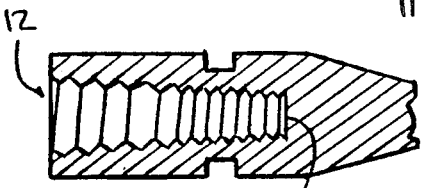
Fig. 3.
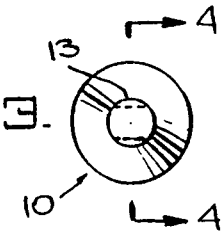
Fig. 7.
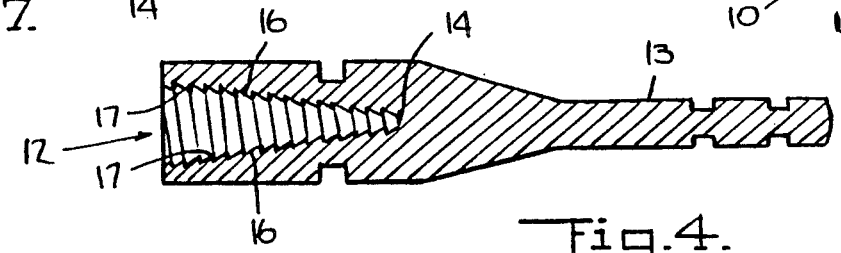
Fig. 4.
Fig. 5.
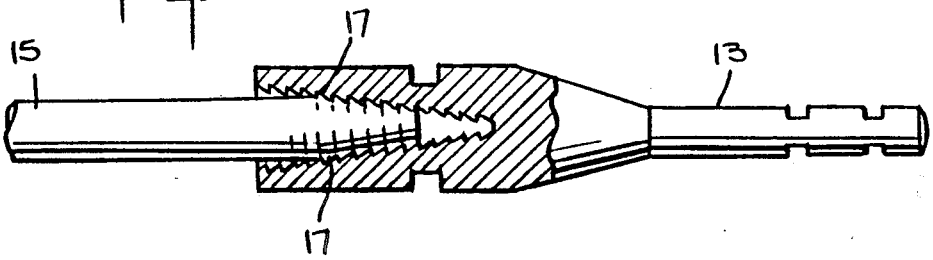
Fig. 6.
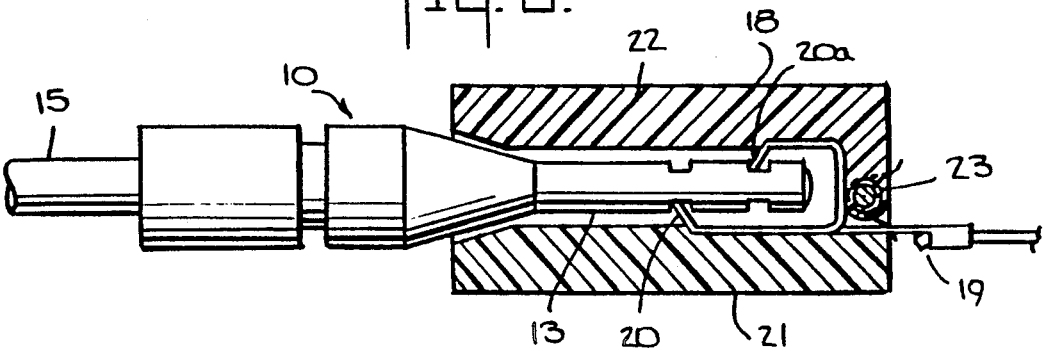

ELECTRICAL CONNECTOR

This is a continuation of application Ser. No. 07/481,973, filed Feb. 16, 1990, now abandoned.

BACKGROUND OF THE INVENTION

1. Field of the Invention

This invention concerns connectors for electrical wires, cables, leads, conductors and the like, and more particularly, to a new and improved switch or connector plug for use in making temporary electrical connection to or from electrical conductors and an electrically operated machine or switchboard or any similar terminal of the type having a plug-receiving socket, such as a spring clip socket. Specifically, this invention concerns solderless, non-crimp connectors for electrical conductors suitable for use in wiring power circuits, audio and video components and other communications lines.

More particularly, the electrical connector of the invention is adapted to connect a current carrying conductor, especially a large diameter speaker wire or cable typically used in high power audio entertainment systems, to a terminal having a plug-receiving socket, such as is typically found in loudspeakers, amplifiers and other audio equipment for commercial and home use.

2. Description of the Prior Art

The use of soldering or crimping to hold electrical conductors such as wire or cable in place in a connector is recognized and widespread. The difficulty encountered with these methods are the expense, inconvenience and difficulty of manipulation.

This problem is avoided by the screw-in or molded fit connector. The difficulty encountered is that these connectors are generally not secure and require additional clamping means to prevent unintentional loosening of the wire.

SUMMARY AND OBJECTS OF THE INVENTION

Accordingly, it is an object of this invention to provide a simple and inexpensive but effective connector for securing the stripped end of an insulated wire or cable without the use of solder, crimping, threading tools, or other external joining means for connection.

It is another object of this invention to provide a strong and efficient electrical connector which may be readily and securely attached to or disconnected from a wire or cable and which secures said conductor in position and obtains electrical connection solely through the gripping of the conductor by means of threading.

It is a further object of this invention to provide a non-crimp, solderless, reliable and easy to use connector for securely connecting a conductor to a terminal or other structure to establish electrical and mechanical connections therebetween.

Yet another object of the invention is to provide a one-piece solderless, non-crimp connector for firmly gripping a conductor and positively locking it against withdrawal by an outward pull on that conductor.

The foregoing objects are achieved in accordance with the present invention by means of a one-piece, solderless, non-crimp electrical wire connector comprising a conductive body member having a tapered bore extending inwardly from an end thereof, said bore being closed at its small end by an end wall and open at its large end to receive an electrical conductor, said conductor-receiving bore having internal threads for engaging and gripping said conductor, an elongated plug member extending generally axially from the opposite end of said body member, said plug member adapted to be inserted and seated upon a complementary socket of a terminal, wherein rotating said connector on said conductor causes the threaded surfaces of said bore to engage and be pressed into said conductor, locking said conductor within said bore and forming an electrical connection therebetween.

DESCRIPTION OF THE DRAWINGS

Further objects and advantages of the invention will appear from the following description as well as from the accompanying drawings which illustrate certain embodiments of the invention. It will be understood that the invention is not limited to the embodiments described and that the drawings are for purposes of illustration only and are not intended as a definition of the limits of the invention. Similar reference numerals refer to similar elements throughout the several views.

FIG. 1 is a perspective view of an exemplary electrical connector in accordance with the invention;

FIG. 2 is a left end elevational view of the connector shown in FIG. 1;

FIG. 3 is a right end elevational view of the connector shown in FIG. 1;

FIG. 4 is a sectional view of the connector shown in FIG. 1 taken along line 4—4 of FIG. 3;

FIG. 5 is similar to FIG. 4 with a conductor inserted in the connector;

FIG. 6 is a side view of the connector shown in FIG. 1 inserted in a complementary socket shown in cross-section which socket is typical of any suitable and proper device of this nature;

FIG. 7 is a fragmentary sectional view of the conductive body member of the connector shown in FIG. 1, with threading shown in two stages.

DETAILED DESCRIPTION OF PREFERRED EMBODIMENTS

The invention comprises a one-piece, solderless, non-crimp electrical wire connector for effecting connection between the stripped ends of an insulated electrical conductor and a socket of a terminal of the type having a plug-receiving bore.

Referring to FIGS. 1 and 4, there is shown a connector 10 formed of a single piece of metal which includes a conductive body member 11 having a tapered bore 12 extending inwardly from one end thereof and a plug portion 13 for attachment to a corresponding socket of a terminal or the like at its opposite end. The bore is closed at its small end by an end wall 14 and open at its large end to receive the end of an electrical conductor 15, such as a wire or cable of the single or multiple strand type. The bore 12 preferably is tapered at a taper angle in the range of approximately 10 to 30 degrees.

The tapered walls 16 of the bore 12 are provided with internal threads 17 which constitute teeth for engaging and firmly gripping the conductor wire or cable 15, so as to prevent the conductor from easily being withdrawn from the bore of the connector. The threading may be of any conventional form, but saw tooth threading is preferred. Left handed or right handed threading may be provided. The open end of the bore may optionally carry a counterbore, not shown, to receive the insulation of the conductor.

An elongated plug portion 13 extends generally axially from the opposite end of the body member 11. The plug portion 13 is adapted to be inserted and seated upon a complementary socket or receptacle 18 of a terminal 19. The socket 18 for securing the plug portion 13 may be of any desired construction and is screwed to or in electrical union with a terminal 19. Shown in FIG. 6 is a socket of the spring clip type having a bottom spring clip contact 20 housed in a fixed insulated housing 21 and a top spring clip contact 20*a* housed in an insulated pivoted housing 22, the pivot being indicated at 23. Pressure exerted on the insulated pivoted housing 22 causes the contacts to open, releasing the plug portion 13 from the socket. Plug portion 13 is optionally notched to obtain a snug and secure fit within the complementary socket. It will be understood that the plug portion 13 including the notches and its complementary socket 18 illustrated in FIG. 3 are merely representative and are not intended to be limiting. Although three notches are shown it will be understood that more or less notches may be provided, the only constraint being the security of the connection. Sample dimensions shown are for purposes of illustration only.

In securing a conductor wire within the connector, it is merely necessary to insert the end of the conductor wire into the tapered, threaded bore of the connector until the end of the wire projects well into the bore and to turn or screw the connector onto the wire so as to advance the end of the wire into the bore until it seats in the position shown in FIG. 5, so that the end of the wire approaches or contacts the end wall of the bore. As the connector is rotated or screwed around the wire, the internal bore threading engages the conductor by biting or forming against the surface of the wire to tightly clamp the wire in the wire-receiving bore so that it is difficult to pull the wire out of the connector using ordinary force. A tight, effective electrical connection is thus provided without the use of solder, crimping by dies or other wire-holding means. Simultaneously, good electrical contact with the wire is established.

The connector is adapted to be threaded or screwed onto the end portion of a conductor wire or cable, cutting or forming a corresponding thread on the outer surface of the relatively soft conductor wire or cable, as the conductor advances longitudinally into the bore. The connector is preferably constructed of any rust-proof metal of sufficient hardness to cut threads in the relatively soft copper customarily used for wire conductors. The thread valleys advantageously offer an increased surface area on the connector bore for interfacial contact with the conductor, thereby reducing the electrical resistance of the connection. Where the thread is cut, a bright clean contact is obtained. When formed, the wire rolls into the bore threading without direct surface pressure, where the wire is soft and/or multi-stranded. Thus, rolling rather than cutting or abrading of the conductor occurs. The conductor wire is pressed securely against the threaded bore surfaces so that the tips of each thread are wedged into the valleys of its complementary thread to thereby effectively lock the conductor to the connector. The tight fit between the conductor and the bore threading reduces the possibility of withdrawing the wire from the connector by a heavy pull and results in a permanent electrical connection which can easily be made without special tools.

As the connector is twisted or screwed onto the conductor wire, the conductor is forced to the interior of the bore. The metal bore threads directly engage the conductor wire and smoothly groove or thread the surface of the wires. As the connector is smoothly twisted over the wires, the partial threads formed in the conductors become increasingly hardened until the wires work-harden sufficiently to prevent further thread formation. At this point, the ends of the conductor will substantially cease their inward movement in the bore and will begin to rotate with the bore. This rotation further coils the insulated portion of the conductor outside of the connector and results in a very tightly wound connection between the wire. The twisting action ceases when the user can no longer rotate the connector on the conductor. The plug portion of the body member is then inserted into the complementary socket, and the connector is secured in place within the socket.

The bore threads are provided with predetermined, pointed tips that smoothly groove and displace the metal of the conductor thereby forming interlocking threads in the conductor without abrasion. The tips of the bore threads have a predetermined diameter in the range of approximately 0.5 mm to approximately 8 mm, it being understood that the diameter of the threads depends on the degree of taper and that the threads may taper down to virtually nothing. Tips of adjacent threads are spaced a distance apart such that a valley between adjacent threads is provided to receive and engage with metal worked from the conductors by the pressure of rotating said connector on said conductor. The valley between adjacent threads may be flat in cross section or may terminate in a point. The sides of the threads leading up to the tips are preferably flat and smooth.

With multi-strand wire it is important that the bore threads not cut or abrade the wire as the connector is turned or screwed onto the wire. To provide the best contact between the bore threads and the conductor, it is necessary that the soft conductor be grooved or threaded, rather than cut or abraded.

The threading, shown as in one stage in FIG. 4, may alternatively be in two stages, as shown in FIG. 7, with the first stage at a pitch of approximately 12 threads/inch, and the second at a pitch of approximately 24 threads/inch. Thread height is a function of thread pitch. Thus, for a pitch of 24 TPI, the thread height is in the range of approximately 1 mm to 3 mm, and at 12 TPI, the height is in the range of approximately 4 mm to approximately 6 mm. It will be understood that these figures are illustrative and are not intended to be limiting.

Once the conductor is secured in place within the connector, it cannot be removed unless the connector is counter rotated to retract the end of the conductor from the connector bore. Each time the connector is removed from or replaced on the wire, the contact faces of both the conductor and the connector bore threads are cleaned and brightened.

It is contemplated that connectors of various sizes, lengths and widths be available to accommodate conductors of various dimensions. For purposes of audio equipment, the connector bore should be in the range of, but not limited to, 1 mm to 6 mm in diameter. It is further contemplated that the connector plug portion be available in a variety of design shapes and sizes to adapt to various commercially available sockets.

It is noted that although this invention is described in the context of an audio reproduction system, the invention herein may be employed in any system where a secure electrical connection is desired.

While the preferred embodiment of the present invention has been shown and described, it will be obvious to one skilled in the art that other modifications, variations, substitutions and alterations may be made thereto without departing from the spirit and scope of the invention, as defined by the appended claims.

I claim:

1. An electrical wire connector comprising:

a conductive body member having a tapered bore extending inwardly from a first end to a second end thereof, with said bore having a diameter at said first end of said body member that is larger than a diameter of said second end of said body member, said bore being tapered to said second end and open at said first end to receive an electrical multi-strand wire conductor, said bore having a first portion adjacent said first end and a second portion spaced from said first portion, the taper angle of said first portion being larger than said taper angle of said second portion, said bore having internal threads for engaging and gripping said conductor, said threads acting as a non-abrasive metal working surface, said threads being continuous and uninterrupted throughout the length of said bore so that rotating said connector on said multi-strand wire conductor causes said threads surfaces of said bore to engage and guide the conductor into said bore locking said conductor within said bore and forming an electrical connection; and an elongated plug member extending generally axially away from the end of said body member opposite said first end, said plug member having a plurality of channels to engage with a plurality of complimentary spring clips of a socket.

2. The connector according to claim 1 further comprising a multi-strand wire conductor for inserting in said open end of said bore.

3. The connector according to claim 1, wherein said first and second portions of said bore are tapered in the range of 10 degrees to 30 degrees.

4. The connector according to claim 1, wherein the taper of said first and second portions of said bore are linear.

5. The connector according to claim 1, wherein said bore is provided with saw tooth threads.

6. An electrical wire connector comprising:

a conductive body member having a tapered bore extending inwardly from a first end to a second end thereof, with said bore having a diameter at said first end of said body member that is larger than a diameter of said second end of said body member, said bore being tapered to said second end and open at said first end to receive an electrical multi-strand wire conductor, said bore having a first portion adjacent said first end and a second portion spaced from said first portion, the taper angle of said first portion being larger than said taper angle of said second portion, said bore having internal threads for engaging and gripping said conductor, said threads acting as a non-abrasive metal working surface, said threads being continuous and uninterrupted throughout the length of said bore so that rotating said connector on said multi-strand wire conductor causes said threads surfaces of said bore to engage and guide the conductor into said bore locking said conductor within said bore and forming an electrical connection;

a multi-strand wire conductor for inserting in said open end of said bore; and an elongated plug member extending generally axially away from the end of said body member opposite said first end, said plug member having a plurality of channels to engage a plurality of complimentary spring clips of a socket.

7. The connector according to claim 6 wherein said first and second portions of said bore ar tapered in the range of 10 degrees to 30 degrees.

8. The connector according to claim 6, wherein the taper of said first and second portions of said bore are linear.

9. The connector according to claim 6, wherein said bore is provided with saw tooth threads.

* * * * *